United States Patent [19]

Iimori

[11] Patent Number: 4,549,805

[45] Date of Patent: Oct. 29, 1985

[54] ELECTROPHOTOGRAPHIC APPARATUS

[75] Inventor: Akiro Iimori, Yokohama, Japan

[73] Assignee: Tokyo Shibaura Denki Kabushiki Kaisha, Kawasaki, Japan

[21] Appl. No.: 525,489

[22] Filed: Aug. 22, 1983

[30] Foreign Application Priority Data

Aug. 31, 1982 [JP] Japan ..... 57-150964

[51] Int. Cl.[4] ..... G03G 15/00

[52] U.S. Cl. ..... 355/3 SH; 355/3 R; 355/14 R; 355/14 SH

[58] Field of Search ..... 355/3 SH, 14 SH, 3 R, 355/14 R; 271/225, 226, 227

[56] References Cited

U.S. PATENT DOCUMENTS 4,318,611 3/1982 Tsuda et al. ..... 355/14 SH 4,451,136 5/1984 Tanioka et al. ..... 355/3 SH X

FOREIGN PATENT DOCUMENTS 3215815 11/1982 Fed. Rep. of Germany .

OTHER PUBLICATIONS

German Patent Office Report (with translation), P 3330867.5 51, 8-26-83.

*Primary Examiner*—A. C. Prescott

*Attorney, Agent, or Firm*—Cushman, Darby & Cushman

[57] ABSTRACT

An electrophotographic apparatus is disclosed, which has a transfer unit for transferring a toner image formed on a photoconductive drum onto a paper sheet and a manual paper feeding section for manually feeding the paper sheet to the transfer unit. A manually fed paper detector is provided in the proximity of the outlet of the manual paper feeding section. If the manually fed paper detector does not detect any paper continuously for a predetermined period of time from the start of a copying operation, this event is judged to be due to a paper feeding error, whereupon the copying operation is interrupted while the electrophotographic apparatus is restored to a stand-by state.

7 Claims, 15 Drawing Figures

ELECTROPHOTOGRAPHIC APPARATUS

BACKGROUND OF THE INVENTION

This invention relates to an electrophotographic apparatus and, more particularly, to an electrophotographic apparatus with a manual paper feeder.

A prior art electrophotographic apparatus has a manually fed paper detector for detecting a paper sheet manually fed into a manual paper feeding section and a manually fed paper transporting roller. When the manually fed paper detector detects a paper sheet, the transporting roller is rotated to feed the paper sheet to aligning rollers disposed immediately before a photosensitive drum in the direction of travel. At this time, the aligning rollers are rotated to align the paper sheet and feed it in an aligned state in between the photoconductive drum and a transfer charger. In another manual paper feeder, a paper sheet is fed from a manual paper feeding section until it reaches the aligning rollers. When a paper detector disposed in the neighborhood of the aligning rollers detects the paper sheet, a state ready for a copying operation is set up. In this state, the copying operation is started by operating a copying start switch.

The latter manual paper feeder has a reduced number of components, so that it is simpler in construction and more inexpensive. However, sometimes a manually fed paper sheet fails to reach the aligning rollers. More specifically, a manually fed paper sheet having been detected by the manually fed paper detector may fail to reach the aligning rollers and thus be supplied to the transfer unit if it is pulled out from the manual paper feeder or falls therefrom. In this event, a control section determines the absence of paper in the transfer unit to be due to paper jamming so it interrupts the copying operation and also executes various safety locking operations. Once this is done, the operation of restoring the electrophotographic apparatus to the normal state requires very cumbersome operations of releasing various locking means. Frequent occurrence of such an event greatly reduces the reliability of the apparatus.

SUMMARY OF THE INVENTION

An object of the invention is to provide an electrophotographic apparatus, which permits resumption of a copying operation immediately after an interruption thereof due to a paper feeding error without any cumbersome restoring operations.

According to the invention, there is provided an electrophotographic apparatus, which comprises a photoconductive member, an exposure unit for exposing the photoconductive member to form a latent image thereon, a developing unit for developing the latent image on the photoconductive member into a visible image, a transfer unit for transferring the visible image onto a paper sheet, and a paper feeding section for supplying paper to the transfer unit, said paper feeding section including a manual paper feeder for manually feeding paper sheets, said manual paper feeder having a manually fed paper detector for detecting a manually fed paper sheet, wherein if the manually fed paper detector does not detect any paper in the case of a copying operation by manual paper feeding for a constant period of time until the start of rotation of aligning rollers after the start of the copying operation, it is judged to be due to a paper feeding error so that the copying operation is interrupted and a stand-by state ready for the resumption of copying operation is restored.

DETAILED DESCRIPTION OF THE PREFERRED EMBODIMENT

Figure 1:
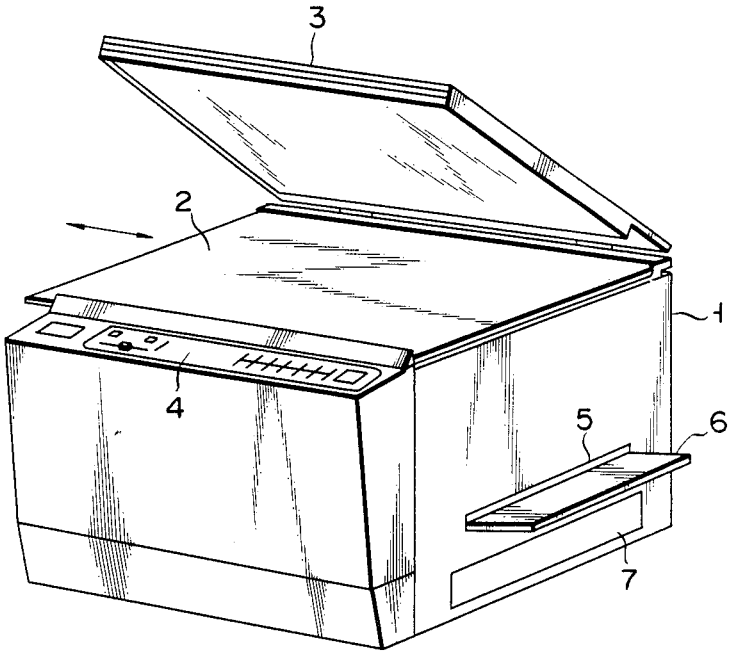
FIG. 1 is a perspective view showing an embodiment of the electrophotographic apparatus according to the invention.

Referring to FIG. 1, there is shown an electrophotographic apparatus having a cabinet 1. A document table 2 is provided on top of the cabinet for reciprocation in the directions of arrows. A document cover 3 is pivotally coupled to the document table 2. An operation panel 4 is provided on top of the cabinet 1. A manual paper feeding section 5 including a manual paper feeding guide 6 and a paper cassette inlet section 7 are provided on one side wall of the cabinet 1.

Figure 2:
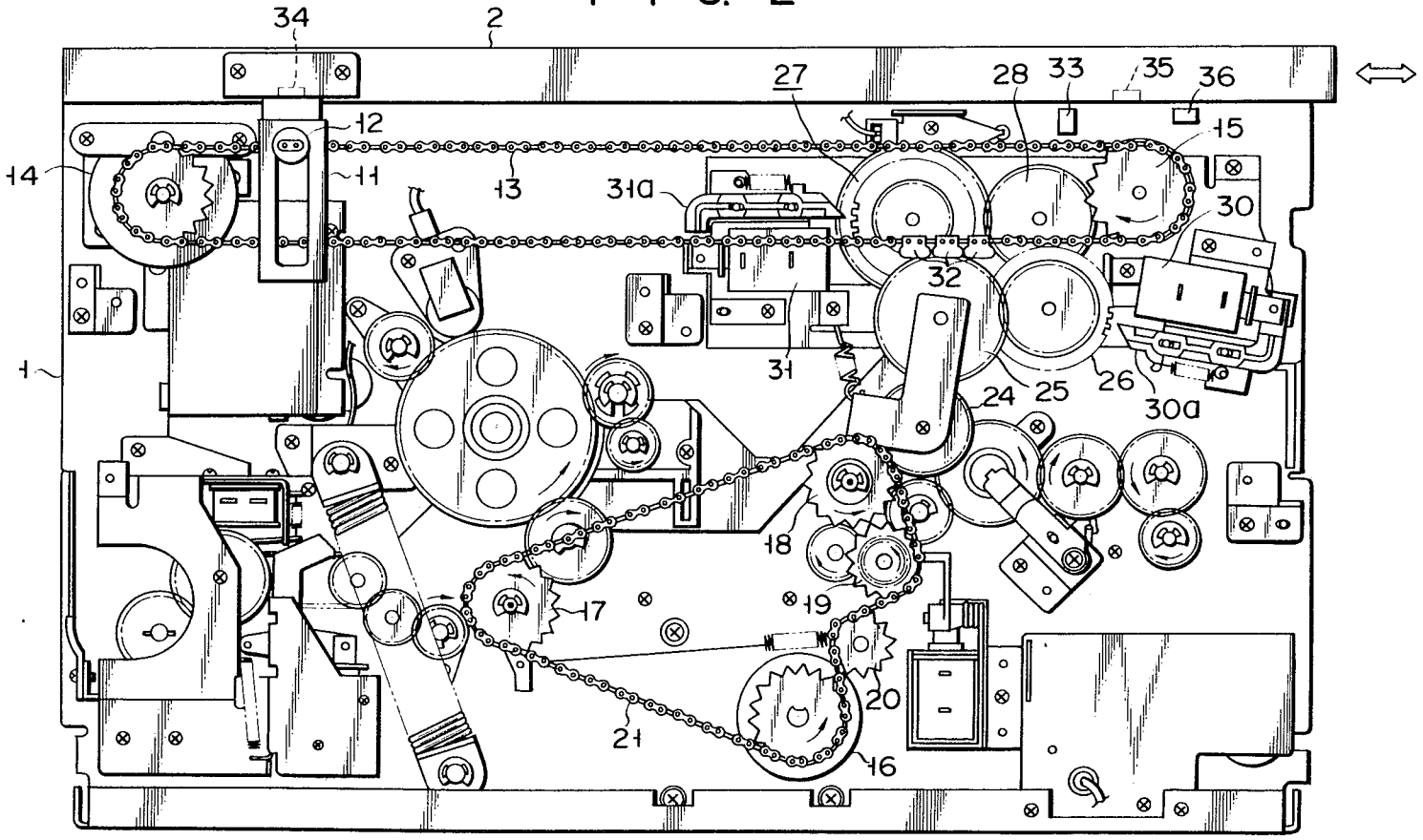
FIG. 2 is a side view showing a mechanism for moving a document table.
Figure 3:
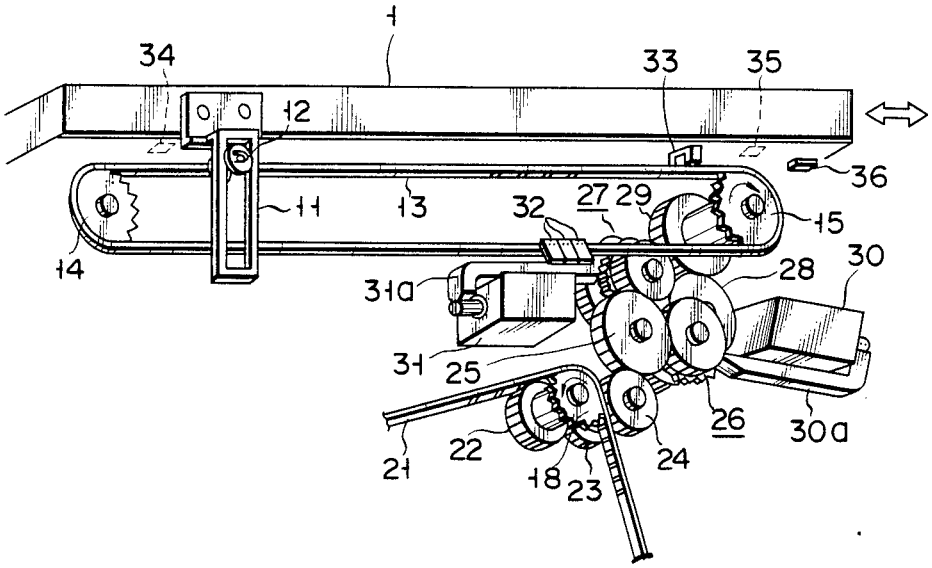
FIG. 3 is a perspective view showing an essential part of a document table moving mechanism.

Referring now to FIG. 2, the document table 2 has a binder 11 having a slot. A pin 12 is received in the slot for vertical movement therealong. An endless chain 13, which is coupled to the pin 12, is passed round opposite side sprocket wheels 14 and 15. A driving torque of a motor (not shown) mounted on a lower portion of the cabinet 1 is transmitted to a sprocket wheel 16. Another endless chain 21 is passed round the sprocket wheel 16 and more sprocket wheels 17 to 20 are disposed in the neighborhood thereof. As is clearly shown in FIG. 3, a gear 22 is mounted on the shaft of the sprocket wheel 18. It is coupled to succesive gears 23 to 25. The gear 25 is coupled through first and second spring clutches 26 and 27 to a gear 28. The gear 28 is in mesh with a gear 29 mounted on the shaft of the sprocket wheel 15. The first spring clutch 26 has an input gear and an output gear. When a ratchet of a plunger 30*a* of a solenoid 30 is coupled to a ratchet gear, the input and output gears are coupled together so that power is transmitted from the input gear to the output gear, that is, power is transmitted from the gear 25 to the gear 28. The input and output gears of the first spring clutch 26 have comparatively few teeth, so that power is transmitted from the gear 25 to the gear 28 at a low speed when the first spring clutch 26 is coupled. The second spring clutch 27, like the first spring clutch, has input and output gears. When a ratchet of a plunger 31*a* of a solenoid 31 is coupled to a ratchet gear, the input and output gears are coupled together to transmit the power of the gear 25 to the gear 28. The input and output gears of the second spring clutch 27 have comparatively many teeth, so that power is transmitted from the gear 25 to the gear 28 at a high speed when the second spring clutch 27 is coupled.

Figure 4A:
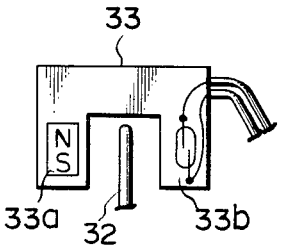
FIGS. 4A and 4B are schematic views showing a home position detecting section.
Figure 4B:
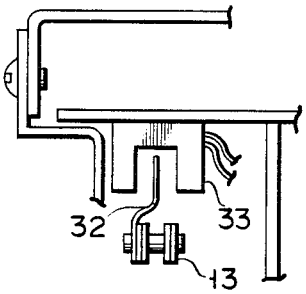

Three metallic shield members 32 are mounted on the chain 13 at a predetermined position thereof. A home position switch assembly 33 is provided in the neighborhood of the sprocket wheel 15. As shown in FIG. 4A, it has a magnet 33*a* and a read switch 33*b* which face each other. The shield members 32 are mounted on the chain 13 such that they can enter the space between the magnet 33*a* and read switch 33*b*. Since the home position switch assembly 33 is disposed at a position in the neighborhood of the sprocket wheel 15 where the chain 13 is less subject to vibrations, it can be stably and reliably operated by the shield members 32.

The document table 2 has magnets 34 and 35 provided at forward and backward sides thereof respectively. A reed switch 36 is provided in the neighborhood of the sprocket wheel 15. It has the same construction as the reed switch 33*b* of the home position switch assembly 33, and can be actuated by the magnets 34 and 35.

Figure 5:
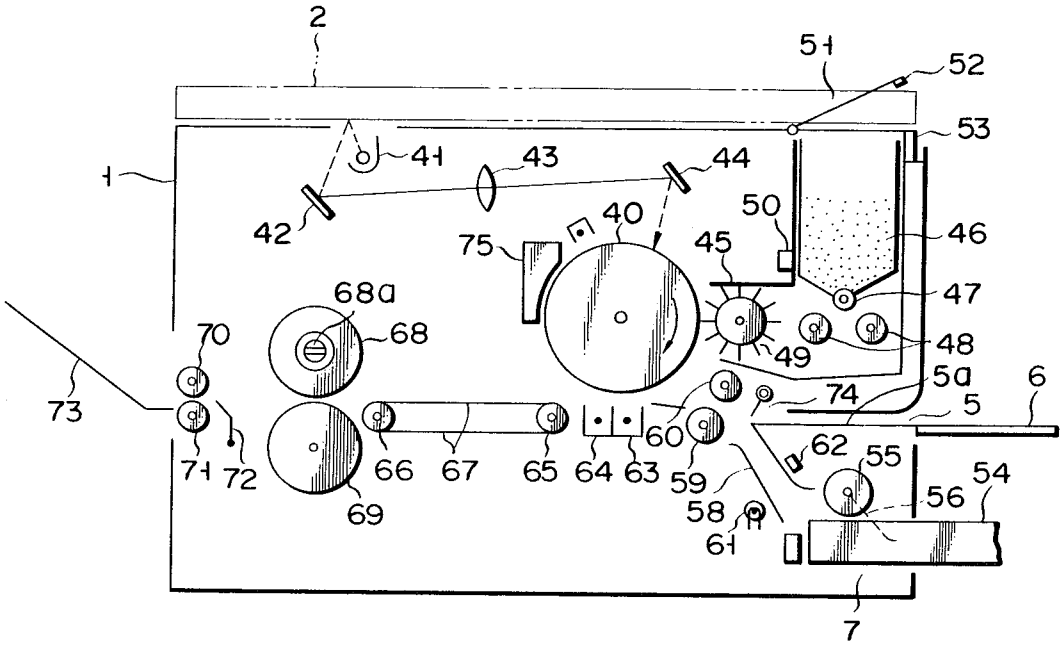
FIG. 5 is a schematic view showing the internal construction of the photographic apparatus of FIG. 1.

FIG. 5 shows the internal construction of the electrophotographic apparatus. A photoconductive drum 40 is disposed in the cabinet 1. An exposure lamp 41 is disposed beneath the document table 2. An exposure optical system comprising a mirror 42, a lens 43 and a mirror 44 leads light reflected from a document set on the document table 2 to the photoconductive drum 40. A developing unit 45 is disposed in the neighborhood of the photoconductive drum 40. It includes a toner hopper 46, a toner supplying roller 47, toner stirring rollers 48, a magnetic brush roller 49 and a lack-of-toner detector 50. A lid 51 is pivotally attached to the toner hopper 46. It has a magnet 52 provided at its free end. A reed switch 53 is installed on the toner hopper 46. It is operated by the magnet 52 when the lid 51 is closed. A paper cassette 54 is inserted in the paper cassette inlet section 7. A paper feeding roller 55 is provided such that it is in contact with the uppermost one of paper sheets accommodated in the paper cassette 54. It has an absence-of-paper detecting switch 56. Paper aligning rollers 59 and 60 are disposed in the neighborhood of the photosensitive drum 40. A paper guide member 58 is disposed between the paper aligning rollers 56 and 60 and paper cassette 54. A light emitting element 61 and a photoelectric element 62 are disposed such that they face each other via the paper guide member 58. A transfer charger 63 is disposed in the neighborhood of the paper aligning rollers 59 and 60 and photoconductive drum 40. A paper removing charger 64 is disposed adjacent to the transfer charger 63. A paper transporting belt 67 is disposed to transport paper sheets removed from the photoconductive drum 40 by the paper removing charger 64 to a fusing section. It is passed round rollers 65 and 66. The fusing section includes a heating roller 68 having a heater lamp 68*a* and a roller 69. Paper discharging rollers 70 and 71 are disposed to discharge copy sheets emerging from the fusing section to a paper discharging tray 73. A switch 72 is provided to detect discharged paper.

The manual paper feeding section 5 has a paper guide table 5*a* extending up to the neighborhood of the paper aligning rollers 59 and 60. A manually fed paper detector, e.g., a paper detecting switch 74, is disposed at the outlet edge of the paper guide table 5*a*.

A cleaning unit 75 is disposed along the photoconductive drum 40 to recover residual toner remaining on the surface of the photoconductive drum 40.

Figure 6:
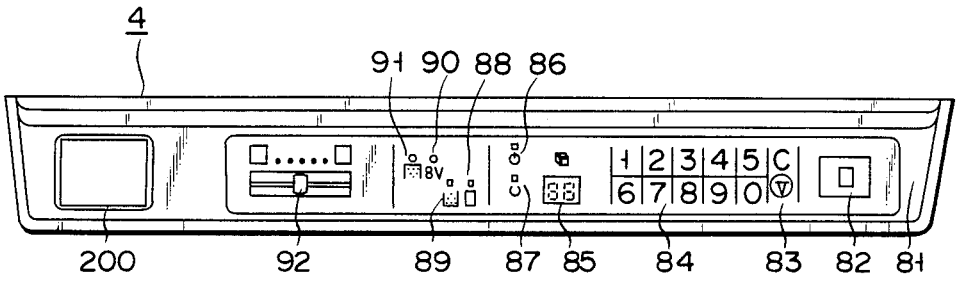
FIG. 6 is a plan view showing an operation panel.
Figure 7:
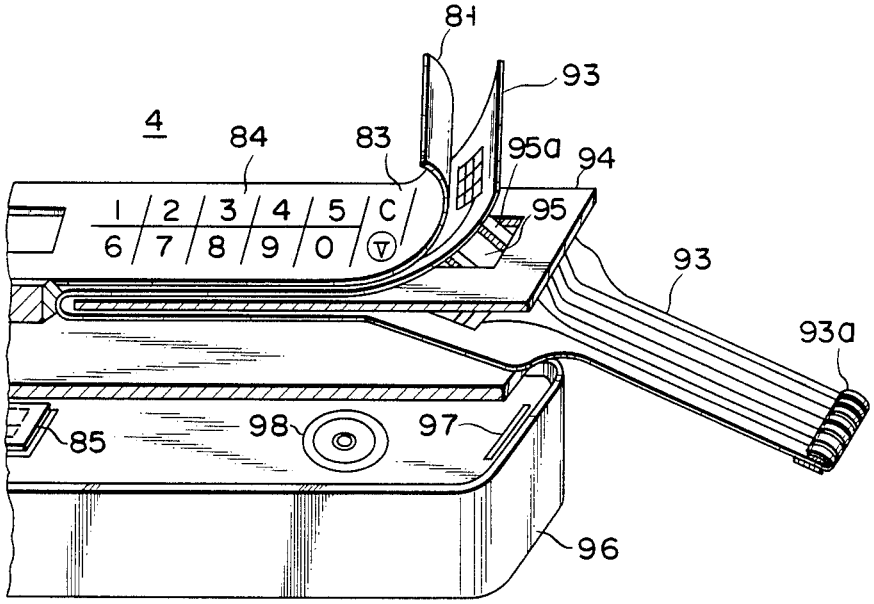
FIG. 7 is a fragmentary perspective view showing the operation panel of FIG. 6.

FIGS. 6 and 7 show the operation panel 4 in detail. It has a decoration sheet 81 covering its entire top. The decoration sheet 81 illustrates graphically various patterns including a print switch area 82, a clear and stop switch area 83, a digit key area 84. It also has a "number-of-copy" display LED 85, a "wait" display LED 86, a "ready-to-copy" display LED 87, an "absence-of-toner" display LED 88 a "paper supplement" display LED 89, a "jamming" display LED 90, a "toner bag exchange" display LED 91, and a copy concentration adjuster 92. A magnet section 200 is provided for holding clips etc. during a copy operation.

The operation panel also includes a switch assembly sheet applied to the back of the decoration sheet 81. The switch assembly sheet is formed of a flexible printed sheet 93 with conductor patterns printed thereon and a spacer 94. The spacer 94 is sandwiched between folded portions of the flexible printed sheet 93. The conductor patterns printed lattice-like on the folded portions of the sheet 93 on the opposite sides of the spacer 94 are in registration with the corresponding patterns on the decoration sheet 81. The conductor patterns on the upper folded portion function as switches. The spacer 94 has windows 95 formed in positions corresponding to the patterns of the sheet 81. Bridge portions 95*a* are suitably formed in the windows 95 to prevent bounding of the sheet 8. The lattice-like conductor patterns on the flexible printed sheet 93 and windows 95 of the spacer 94 are formed such that those corresponding to the print switch area 82 are greater than those corresponding to the clear and stop switch area 83 and those corresponding to the clear and stop switch area 83 are greater than those corresponding to each element area in the digit key area 84. The conductor patterns on the lower folded portion of the flexible printed sheet 93 serve as cable lines. The end 93*a* of cable is led into a casing 96 of the operation panel through a slit 97 formed therein and connected to a connector of a control circuit board provided in the casing 96. The "number-of-copy" display LED 85 and a buzzer 98 are mounted on the casing 96. The buzzer 98 is operated when various operation modes set by the operation panel 4 are effective. It is also operated when the "wait" display LED 86, which is turned on when the power switch is turned on, is turned off.

Figure 8:
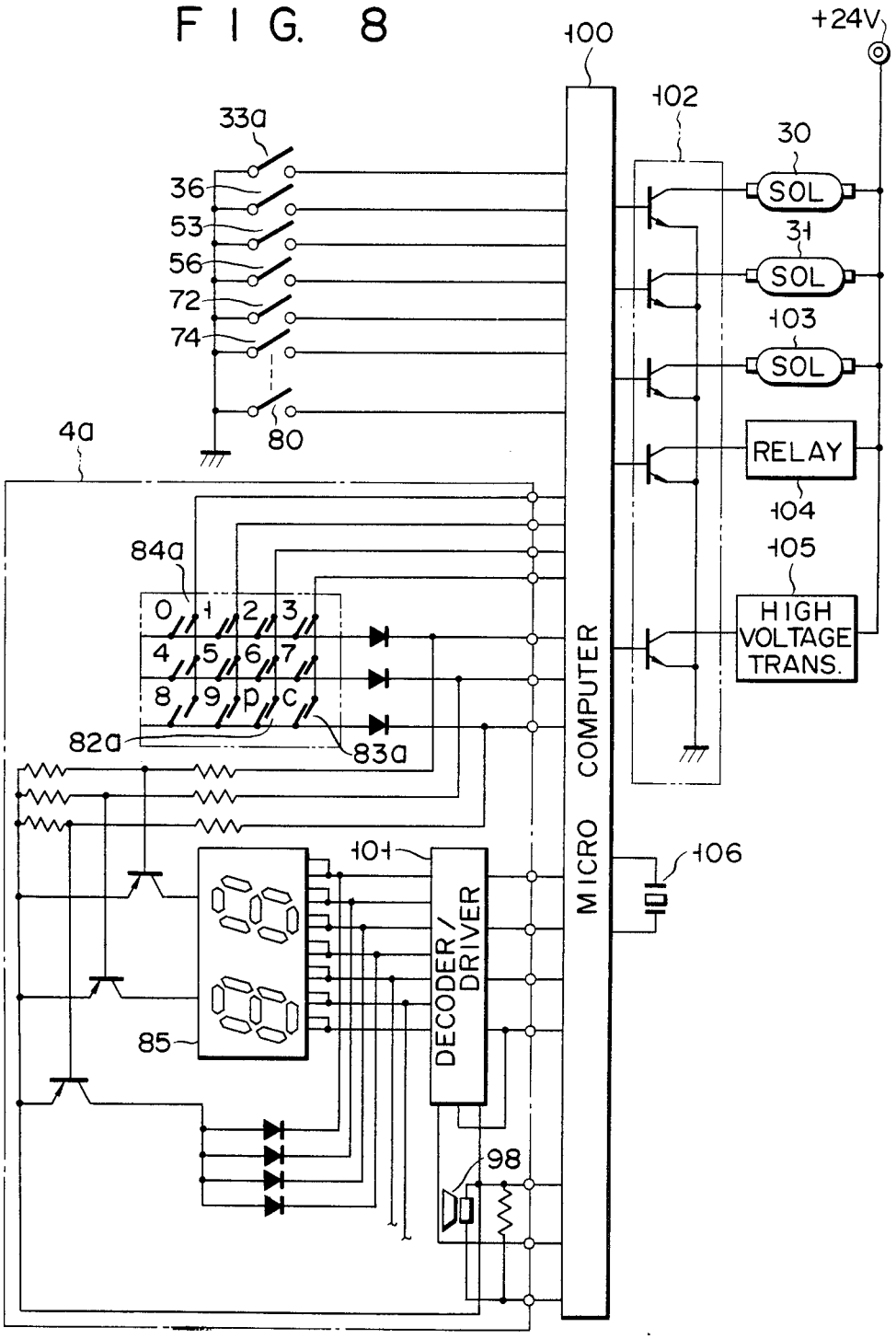
FIG. 8 is a schematic view showing the electric circuit of the electrophotographic apparatus.

FIG. 8 shows the electric circuit of the electrophotographic apparatus. A microcomputer 100 is provided to cause various programmed operations in a copying process. The home position switch 33*a*, reed switch 36, reed switch 53, absence-of-paper detecting switch 56, discharged paper detecting switch 72, manually fed paper detecting switch 74, full-of-toner switch 80, etc. are connected to the microcomputer 100. A control circuit 4*a* of the operation panel 4 is also connected to the microcomputer 100. It includes a print switch 82*a* corresponding to the print switch area 82, a clear switch 83*a* corresponding to the clear and stop switch area 83 and numeral keys 84*a* corresponding to the digit key switches 84. The "number-of-copy" display LED 85 is connected to the microcomputer 100 through a decoder/driver 101. Solenoids 30 and 31 for operating the spring clutches 26 and 27, a solenoid 103 for a further spring clutch, a relay 104 and a high voltage transformer 105 are connected to the microcmputer 100 through a driver 102. An oscillator 106 as a clock generator is further connected to the microcomputer 100.

The operation of the electrophotograhic apparatus having the above construction will now be described.

Figure 9A:
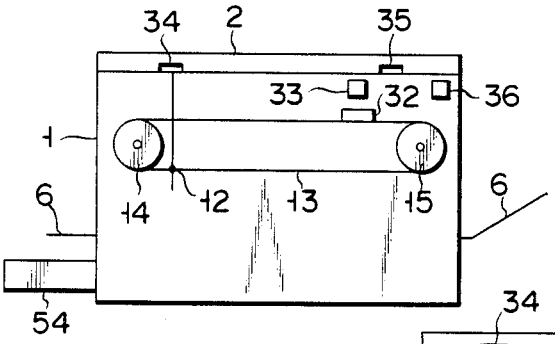
FIGS. 9A through 9E are views illustrating respective positions of the document table.
Figure 9B:
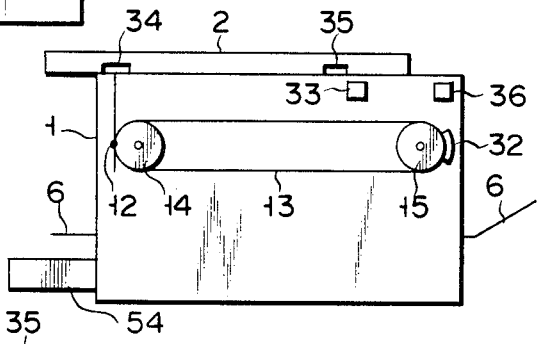

When the power source switch is turned on, the microcomputer 100 turns on the "wait" display LED 86 and also the heater lamp 68*a* of the heating roller 68. When a fusing temperature is reached by the heating roller 68, the "wait" display LED 86 is turned off. This state is a stand-by state of the electrophotographic apparatus. In this state, the document table 2 is at a home position as shown in FIG. 9A, and the reed switch 33*b* of the home position is "off" with the magnetic shield members 32 found between it and magnet 33*a*. If the paper cassette 54 is loaded in the cassette inlet section 7 and contains paper sheets at this time, the microcomputer 100 turns on the "ready-to-copy" display LED 87. When the print switch area 82 is depressed in this state, the print switch 82*a* is closed. It also energizes the solenoid 30 in response to the closure of the print switch 82*a*. As a result, the first spring clutch 26 is coupled to transmit a low-speed drive force to the sprocket wheel 15. The chain 13 is thus driven at a low-speed to move the document table 2 from the home position in a backward direction to a start position shown in FIG. 9B. With this movement of the document table 2 the shield members 32 get out of the home position switch assembly 33, thus turning on the reed switch 3*b*. The microcomputer 100 turns on the exposure lamp 41 and starts the photoconductive drum 40 in response to the closure of the reed switch 33*b*. At this time, the paper feeding roller 55 is rotated to feed out a paper sheet from the paper cassette 54 along the paper guide 58 to the aligning rolles 59 and 60. At ths same time, the photoconductive drum 40 is charged by the charger. As soon as the document table 2 reaches the start position, it turns to be moved in the forward direction. During the forward movement of the document table 2, a document set thereon is illuminated by the exposure lamp 41, and the photosensitive drum 40 is exposed to light reflected by the document and led to it via the route of the mirror 42, lens 43 and mirror 44. A latent image corresponding to the document pattern is thus formed on the surface of the photoconductive drum 40. This latent image is developed into a toner image by the developing unit 45.

Figure 9C:
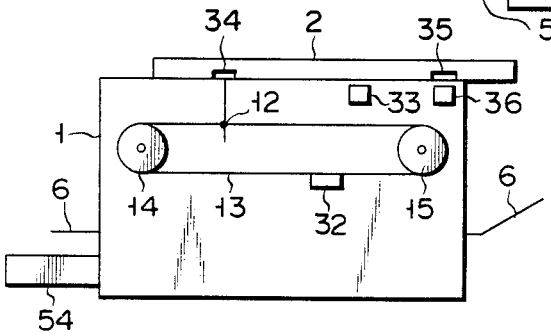
Figure 9D:
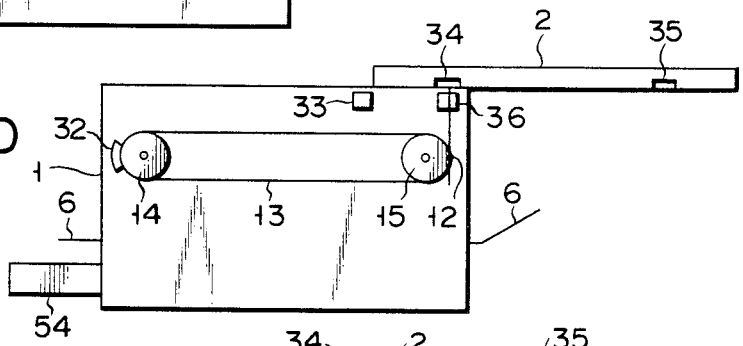
Figure 9E:
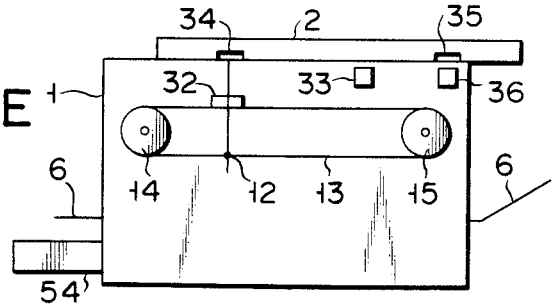

When the document table 2 comes to a position, at which the magnet 35 faces the reed switch 36 as shown in FIG. 9C, the reed switch 36 is turned on. In response to the close of the reed switch 36 the microcomputer 100 causes the paper sheet to be transported by the aligning rollers 59 and 60 to between the photoconductive drum 40 and transfer charger 63. The transfer charger 63 effects transfer of the toner image from the photoconductive drum 40 to the paper sheet. Subsequent to the transfer, the paper sheet is separated from the photoconductive drum 40 by the paper removing charger 64 and transported on the paper transporting belt 67 to between the heating rollers 68 and 69. As the paper sheet passes between the heating rollers 68 and 69, the toner image on it is fixed to it by the heat of the heating roller 68. The paper sheet emerging from between the heating rollers 68 and 69 is discharged by the discharging rollers 70 and 71 into a discharging tray 73. Meanwhile, the document table 2 is continually moved in the forward direction. When it comes to a limit position as shown in FIG. 9D, at which the magnet 34 faces the reed switch 36, the reed switch 36 is again turned on. In response to the closure of the reed switch 36, the microcomputer 100 energizes the solenoid 31, thereby actuating the second spring clutch 27. At this moment, the solenoid 30 remains energized to hold the first spring clutch 26 coupled. This means that high-speed power is not transmitte immediately to the sprocket wheel 15 when the second spring clutch 27 is coupled. To be more specific, the first spring clutch 27 is continually held coupled to transmit the low-speed power to the sprocket wheel 15 for a response period, i.e., until a predetermined restoring force is stored in the spring of the second spring clutch. This has the effect of preventing an idling run of the document table 2. The response period of the second spring clutch 27 is preset by the microcomputer 100. When this response period is passed, the solenoid 30 is deenergized to decouple the first spring clutch 26. At this instant, high-speed power is reliably transmitted from the second spring clutch 27 to the sprocket wheel 15. The document table 2 is now moved from the limit position in the backward direction at a high speed. It returns at the high speed past the position of FIG. 9E to the home position of FIG. 9A. When the document table 2 reaches the home position, the reed switch 33*a* of the home position switch assembly 33 is turned off by the shield members 32. After the lapse of a short period of time from the opening of the reed switch 33*a*, the solenoid 31 is deenergized to decouple the second spring clutch 27. The document table 2 is moved past the home position and is stopped at the start position. When the home position switch assembly 33 is turned off with the forward movement of the document table 2, the microcomputer 100 drives the paper feeding roller 55 and turns on the exposure lamp 41 for a second copy. When a predetermined period of time has passed with the document table 2 in the start position, the solenoid 30 is energized to couple the first spring clutch 26 to cause the forward movement of the document table 2 at the low speed again. A second copy is thus obtained through the same operation as for the first copy. The document table 2 is held stationary at the start position before the copying operation for the second copy for the following reason. The start of paper feeding and the turning-on of the exposure lamp 41 is casued at the same timing, i.e. in response to the opening of the home position switch assembly 33, for both the first and second copies. However, the document table 2 is moved forward from the home position to the start position at low speed for the first copy while it is moved at high speed for the second copy. To make up for the difference between these two speeds, the document table 2 is held stationary for a short time for the second copy. When the document table 2 returning in the forward direction in the copying operation for the second copy reaches the home position, it is stopped at this position to bring an end to the copying sequence.

Sometimes the document table 2 is not at the home position when the copying operation is started. In this case, the home position switch assembly 33 is turned on so that the solenoid 31 is first energized to couple the second spring clutch 27. The document table 2 thus is first moved at the high speed. When it reaches the home position, the home position switch assembly 33 is turned off. The copying operation is thus started with the document table 2 at the home position.

Figure 10:
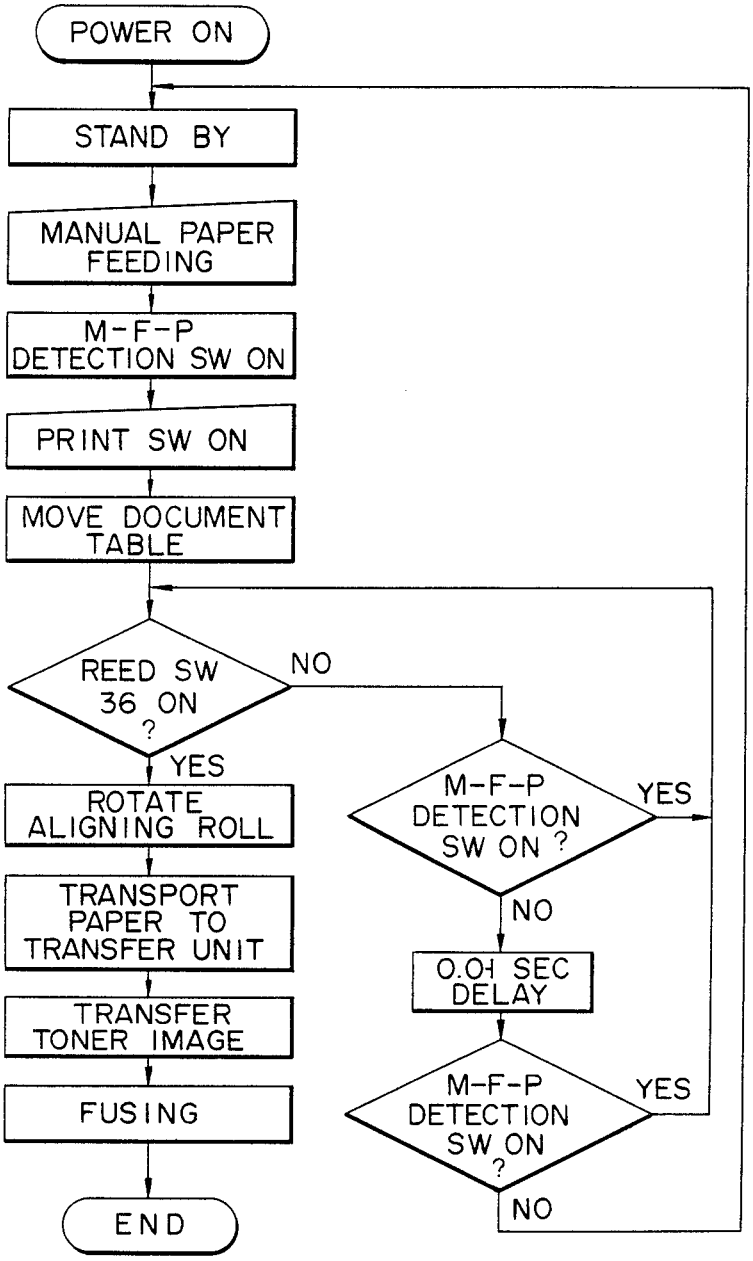
FIG. 10 is a flow chart for explaining a copying operation by manual paper feeding.

The copying operation in the case of manual paper feeding will now be described with reference to the flow chart of FIG. 10.

In the stand-by state of the electrophotographic apparatus after the extinguishment of the "wait" display LED 86 on the operation panel 4, by manually inserting a paper sheet along the manual paper feeding guide 6 into the manual paper feeding section 5, the manually fed paper detecting switch 74 is turned on by the paper sheet. The microcomputer 100 causes flickering of the "ready-to-copy" display LED 87 in response to the closure of the detecting swith 74. By turning on the print switch 82*a* by depressing the print switch area 82 in this state, the microcomputer 100 starts a series of operations. To be more specific, in response to the closure of the print switch 82*a* the document table 2 is moved from the position of FIG. 9A to the position of FIG. 9C. During this period, the charging, exposure and development are effected. When the document table 2 reaches the position of FIG. 9C, the read switch 36 is turned on by the magnet 35, whereupon the aligning rolles 59 and 60 are driven to feed the manually fed paper sheet to between the photoconductive drum 40 and transfer charger 63. The transfer charger 63 effects the transfer of the toner image onto the paper sheet. Subsequent to the transfer, the paper sheet is separated from the photoconductive drum 40 by the paper removing charger 64 and transported on the paper transporting belt 67. The paper sheet 68 is subjected to the fixing by the heating roller 68 and then discharged into the discharging tray 73.

In the above operation, when the trailing edge of the paper sheet being transported by the aligning rollers 59 and 60 to the transfer section leaves the manually fed paper detecting switch 74 and the switch 74 is turned off, the rotation of the aligning rollers 59 and 60 stop after a predetermined time interval. The aligning rollers are now ready to accept the next manually fed paper sheet.

If the detecting switch 47 is "off" for a predetermined period of time during the period from the closure of the print switch 82*a* till the document table 2 reaches the position of FIG. 9C, the microcomputer 100 judges this as improper transport of paper or paper detachment. At this time, it interrupts the copying operation and brings the apparatus back to the stand-by state. More specifically, the microcomputer 100 monitors the state of the detecting switch 74 after the start of the copying operation and, if it detects a paper feeding error, e.g., detachment or fall of a paper sheet, it restores the apparatus to the stand-by state instead of completely, stopping the apparatus.

The apparatus is restored to the stand-by state in the event of a paper feeding error only in manual paper feeding. This is not so, however, in the following event.

If manual paper feeding is carried out while the aligning rollers 59 and 60 are being rotated during automatic paper feeding, it is judged to be a jam.

If manual paper feeding is carried out while the aligning rollers 59 and 60 are not rotated in the automatic paper feeding, the microcomputer 100 causes the same operation as when the stop key 200 is turned on, and the multi-copy copying operation is interrupted. At this time, the "number-of-copy" display LED 85 displays the remaining number of copies. After such interruption of the multi-copy copying operation, it is possible to cause a copying operation by manual paper feeding. Doing so does not change the content of display of the "number-of-copy" display 85.

When the copying operation by manual paper feeding caused after the interruption of the multi-copy copying operation is over, the multi-copy copying operation by automatic paper feeding for the remaining number of copies can be started by turning on the print switch 82*a* again. When the multi-copy copying operation is over, the same number-of-copy data as at the time of the start of this copying operation is displayed on the display 85.

Now, the operations that are caused by various detecting switches will be described.

When the paper cassette 54 runs out of paper or when it is pulled out from the cassette inlet 7, the absence-of-paper switch 56 is turned on. In response to this, the microcomputer 100 causes blinking of the "paper supplement" display LED 89. In this state, by inserting a paper cassette 54 with paper sheets therein into the cassette inlet 7, the "paper supplement" display LED 89 is turned off. At this time, the display LED 89 is turned off when the "absence-of-paper" detecting switch 56 has been "on" for at least 0.5 second in order to prevent unsteadiness that might result from the removal and reinsertion of the paper cassette 54.

The absence-of-toner detector 50 is operated when the toner in the toner hopper 46 becomes less than a predetermined quantity. In response to a detection signal from the detector 50, the microcomputer causes flickering of the "absence-of-toner" display LED 88. The display LED 88 is extinguished after toner has been added and when the lid 51 is closed after being opened. The opening and closing of the lid 51 are detected by the magent 52 and reed switch 53. When the reed switch 53 is turned off, the microcomputer 100 sets a flag. When the lid 51 is opened, the "ready-to-copy" display LED 87 is extinguished if the electrophotographic apparatus is in the stand-by state for safety reasons. When the lid 51 is opened during the copying operation, the solenoid 30 is forcibly deenergized to prevent running of the document table 2 at high speed.

When paper jamming occurs, the microcomputer 100 causes flickering of the "jamming" display LED 90. This jamming display is caused by the following.

(1) The discharged paper detecting switch 72 or manually fed paper detecting switch 74 turns on when the power source switch is turned on.

(2) The manually fed paper switch 74 turns on while the aligning rollers 59 and 60 are rotating during copying operation by automatic paper feeding.

(3) The manually fed paper detecting switch 74 has been on for a predetermined period of time in manual paper feeding.

(4) The discharged paper detecting switch 72 fails to turn on after the lapse of a predetermined period of time from the start of rotation of aligning rollers 59 and 60 with the document table 2 in the position of FIG. 9C.

(5) The discharged paper detecting switch 72 has been "on" for a predetermined period of time after the lapse of a predetermined period from the start of rotation of the aligning rollers with the document table 2 in the position of FIG. 9C.

(6) The document table 2 fails to move from the home position (FIG. 9A) to the transfer start position (FIG. 9C) so that the reed switch 36 does not turn on.

(7) The document table 2 fails to reach the limit position (FIG. 9D) after the lapse of a predetermined period of time from the start of its movement from the position of FIG. 9C so that the reed switch 36 does not turn on.

(8) The home position switch 33 is turned off in a predetermined period of time after the closure of the reed switch 36 caused by the document table 2 reaching the position of FIG. 9C (for instance due to a high speed backward movement of the document table 2 caused by erroneous coupling of the second spring clutch).

(9) The home position switch 33 fails to turn on in a predetermined period of time after the closure of the reed switch 36 caused by the document table 2 reaching the limit position (FIG. 9D).

(10) The document table 2 will not properly return to the home position at high speed for the start of copying so that home position switch does not turn on.

In any one of the above events, the "jamming" display LED 90 is turned on.

When the toner bag 78 becomes full of the recovered toner, the "full-of-toner" switch 80 is turned on. In response to this, the microcomputer 100 causes flickering of the "toner bag exchange" LED 91 and interrupts the copying operation.

Once the flickering of the "jamming" display LED 90 or "toner bag exchange" display LED 91 is caused, the microcomputer 100 does not stop the flickering unless the power source is disconnected. The flickering of the "wait" display LED 86, "paper supplement" display LED 89 and "absence-of-toner" display LED 88 indicates a faulty light or a preparatory state, so it can be stopped without disconnecting the power source.

Serious defects are displayed in red (by the LEDs 90 and 91), light defects are displayed in yellow (by the LEDs 86, 88 and 89) and a normal condition is displayed in green (by the LED 87).

As has been described in the foregoing, according to the invention if the manually fed paper detector does not detect any paper in the manual paper feeding operation for a set period of time until the start of rotation of the aligning rollers after the copying operation has been started, it is judged to be due to a paper feeding error. The copying operation is then interrupted and the stand-by state for the resumption of copying operation is restored. Thus, the copying operation can be resumed immediately after interruption due to a paper feeding error without the need by any cumbersome restoring operations.

What is claimed is:

1. An electrophotographic apparatus comprising:

a photoconductive member;

means for charging said photoconductive member;

means for exposing said photoconductive member to form a latent image of a document pattern on said photoconductive member;

means for developing said latent image on said photoconductive member into a visual image;

means for transferring said visible image onto a paper sheet;

manual paper feeding means for manually feeding a paper sheet to said transferring means;

manually-fed paper detecting means for detecting the paper sheet fed from said manual paper feeding means; and control means for making a copying operation start in response to the operation of said manually-fed paper detecting means and for confirming the operation of said manually-fed paper detecting means after a predetermined period of time from the start of the copying operation, said control means including means for continuing the copying operation in response to the confirmation of the operation of said manually-fed paper detecting means and for restoring the copy operation to a standby state in response to the absence of confirmation of the operation of said manually-fed paper detecting means.

2. The electrophotographic apparatus according to claim 1, wherein said manually fed paper detecting means comprises switch means operated by a manually fed paper sheet.

3. The electrophotographic apparatus according to claim 1, which further comprises aligning means disposed on a paper path from said manual paper feeding means to said transferring means and after said manually fed paper detecting means in the direction of progress of paper, a paper sheet fed from said manual paper feeding means being aligned by said paper aligning means before being fed to said transfer means.

4. The electrophotographic apparatus according to claim 3, wherein said paper aligning means includes a pair of aligning rollers.

5. The electrophotographic apparatus according to claim 3, wherein said paper aligning means is stopped to be ready to accept a manually fed paper sheet when the trailing edge of the preceding manually fed paper sheet is detected by said manually fed paper detecting means.

6. The electrophotographic apparatus according to claim 1, which further comprises automatic paper feeding means disposed on the side of the apparatus on which said manual paper feeding means is disposed.

7. The electrophotographic apparatus according to claim 1, further comprising aligning roller means for aligning a paper wherein said control means confirms the operation of said manually-fed paper detecting means for a period of time until the start of the aligning roller means after the start of the copying operation.

* * * * *